US006497202B2

(12) United States Patent
Buysse

(10) Patent No.: US 6,497,202 B2
(45) Date of Patent: Dec. 24, 2002

(54) ENGINE FLUID COOLING SYSTEMS AND METHODS

(75) Inventor: John Buysse, St. Paul, MN (US)

(73) Assignee: STAC Inc., St. Paul, MN (US)

( * ) Notice: Subject to any disclaimer, the term of this patent is extended or adjusted under 35 U.S.C. 154(b) by 0 days.

(21) Appl. No.: 09/790,337

(22) Filed: Feb. 22, 2001

(65) Prior Publication Data

US 2001/0023669 A1 Sep. 27, 2001

Related U.S. Application Data

(60) Provisional application No. 60/184,099, filed on Feb. 22, 2000.

(51) Int. Cl.[7] ..... F01P 5/14
(52) U.S. Cl. ..... 123/41.15; 123/41.01
(58) Field of Search ..... 123/41.15, 41.01

(56) References Cited

U.S. PATENT DOCUMENTS 2,498,637 A * 2/1950 Bay
2,670,933 A * 3/1954 Bay
5,004,042 A * 4/1991 McMorries, IV et al.
5,441,099 A * 8/1995 Yasso
5,599,217 A * 2/1997 Ferrante
6,053,131 A * 4/2000 Mueller et al.

OTHER PUBLICATIONS

"Water Circulation Systems," *http://www.crracing.com/wcirc.html*, Feb. 20, 2001.*

* cited by examiner

*Primary Examiner*—Tony M. Argenbright
*Assistant Examiner*—Katrina B. Harris
(74) *Attorney, Agent, or Firm*—Dicke, Billig & Czaja, P.A.

(57) ABSTRACT

A portable, self-contained apparatus for cooling automotive engine fluid, e.g. engine coolant, includes quick couplers for connection to an automotive engine. The apparatus receives hot engine fluid from the engine, cools the engine fluid, and returns the cooled engine fluid to the engine. A fluid reservoir and one or more heat exchangers aid in the cooling process. Corresponding methods provide similar advantages.

27 Claims, 8 Drawing Sheets

ENGINE FLUID COOLING SYSTEMS AND METHODS

CROSS-REFERENCE TO RELATED APPLICATION

The subject matter of this application is related to the subject matter of U.S. Provisional Patent Application No. 60/184,099, filed Feb. 22, 2000, priority to which is claimed under 35 U.S.C. §119(e) and which is incorporated herein by reference.

BACKGROUND OF THE INVENTION

1. Field of the Invention

The invention relates to cooling systems and methods. More particularly, specific aspects of the invention provide portable cooling systems and methods that quickly reduce the temperature of an automotive engine.

2. Description of Related Art

In automotive races sponsored by the NASCAR organization, for example, cars are allowed to run warm-up laps for a specified period of time, e.g. one hour, prior to running qualifying laps. During the warm-up laps, a car runs a series of timed laps. The car is then brought back into the garage area for adjustments, and then sent back out for more laps. This process continues for e.g. one hour or other designated time.

When the car is brought back in for adjustments, it is important for the race team to cool the engine as fast as possible, so that appropriate adjustments can be made and the car sent back out. The more laps the car can run during the warm-up laps, the better the race team can tune the car for the qualifying laps. To provide the best adjustments, it is best for the car to be sent out each time at approximately the same temperature. Currently, cars of this type are able to cool their engines to 10–20 Fahrenheit degrees above ambient temperature prior to the qualifying laps.

When the race team runs the qualifying laps, they typically will unhook the fan belts and tape off the grill. This is done so that all possible horsepower is used to give the fastest possible qualifying lap. With fan belts off and the grill taped off, the car has little to no cooling during the qualifying laps themselves. For this additional reason, it is very important for the car to start at the lowest possible temperature.

One current way to cool race car engines is with a machine that uses ice cubes. As engine coolant is circulated into the machine, ice is added to the coolant reservoir to directly cool the reservoir. Adding ice to the reservoir, however, often causes the reservoir to overflow. A valve is opened and the coolant is allowed to spill out directly onto the garage floor, driveway, or other underlying surface. This spillage presents at least two problems. First, the spilled coolant can be very hot and can flow into areas where crews are working, causing the potential for burns or other serious injuries. Second, race teams often take the temperature of the tires in different locations after the car returns from a warm-up lap. If coolant is being spilled onto the driveway, the car may drive through the coolant, changing the tire temperatures and providing the race team with inaccurate tire temperature information. Note FIG. 1, for example, which shows coolant or other fluid spillage 10 on driveway or other road surface 20. Car 30 must drive through and/or rest in spillage 10, potentially creating the above-described problems.

SUMMARY OF THE INVENTION

Aspects of the invention overcome the problems described above, and other problems. Aspects of the invention provide a portable cooling system that reduces the temperature of an engine or other similar device or system. Engine coolant is circulated through one or more heat exchangers and a reservoir. The coolant is pumped or otherwise directed through the engine block via a product pump or equivalent device. One or more of the heat exchangers are e.g. of the "liquid-to-air" type, the "liquid-to-liquid" type, or of both types. Aspects of the invention can be operated manually or automatically, e.g. through a series of electrical controls.

Aspects of the invention have particular application to vehicles used in the racing sport. An engine block is rapidly cooled, so that adjustments can be made and more warm-up laps run. Aspects of the invention allow initial engine temperature to be quickly and significantly reduced, compared to current cooling systems. Cars can start cooler and run faster throughout the entire qualifying lap, for example, giving the race team a better pole position on race day.

Other features and advantages according to the invention will become apparent from the remainder of this patent application.

BRIEF DESCRIPTION OF THE DRAWINGS

Embodiments of the invention will be described with reference to the Figures, in which like reference numerals denote like elements, and in which.

DETAILED DESCRIPTION OF PREFERRED EMBODIMENTS

Figure 1:
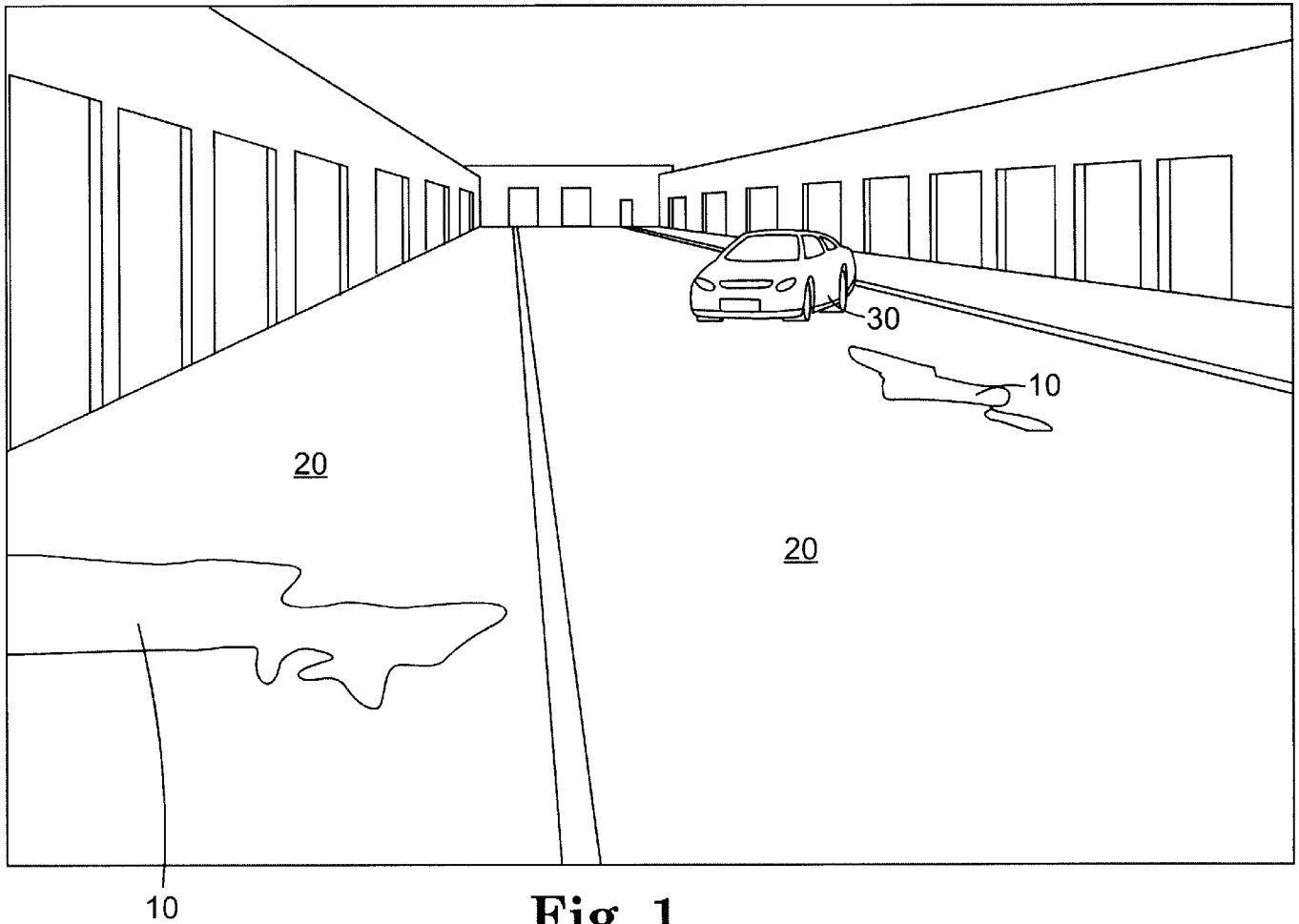
Fig. 1 PRIOR ART
FIG. 1 shows typical coolant spillage on a driveway for racing automobiles.
Figure 2:
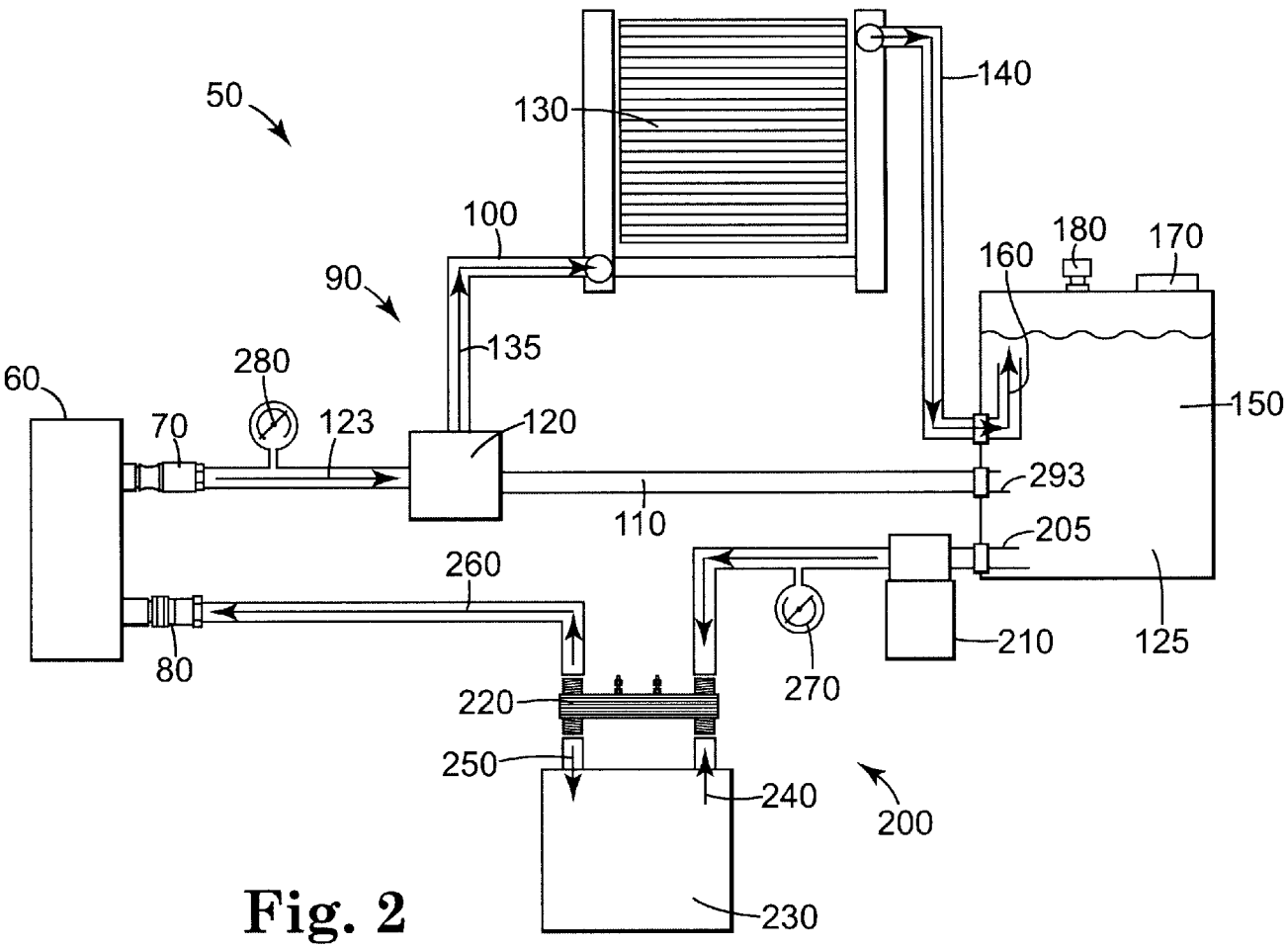
FIG. 2 is a schematic of a cooling system according to an embodiment of the invention, showing quick couplers connected to an engine for cool-down.

FIG. 2 shows a cooling system attached to an engine in order to cool it down. Quick couplers connect the system to the engine, using e.g. hoses or similar devices for transporting hot fluids. Engine coolant is a primary fluid contemplated for use according to the invention, but use with one or more additional or alternative fluids, either instead of or simultaneously in addition to coolant, is also contemplated. Other such fluids include, but are not limited to, engine oil, transmission oil, and brake fluid. For simplicity, the term "coolant" will generally be used throughout this description. The invention, however, should not be considered limited to this particular fluid. The flow path shown in FIG. 2 is held until coolant temperature is reduced to a desired level, e.g. about 100° F. according to one particular example.

More specifically, cooling system 50 is provided for reducing the temperature of engine 60. Cooling system 50 includes first connection device 70, e.g. a quick-coupler, quick-disconnect, or the like, for connecting and disconnecting system 50 to/from engine 60. Similarly, second connection device 80 is of similar construction and is also for connection to and disconnection from engine 60. Although not shown in FIG. 2, hoses or the like can be used to convey fluid between couplers 70, 80 and engine 60.

Cooling system 50 includes "hot" coolant path 90, which extends from coupler 70 and is divided into two portions 100, 110. Thermal bypass valve 120 determines whether coolant flow 123 will proceed along portion 1 10 to coolant reservoir 125, or along portion 100 to heat exchanger 130. FIG. 2 illustrates coolant flow proceeding at 135 along portion 100 to heat exchanger 130. Flow along portion 110 will be described in more detail with respect to FIGS. 3 and 4.

Heat exchanger 130 preferably is a liquid-to-air heat exchanger. A fan, e.g. a single fan (described later with respect to FIGS. 5–6), provides air flow over the cooling fins of heat exchanger 130. According to particular embodiments of the invention, the total surface area of the cooling fins can be about 100 $in^2$, about 500 $in^2$, about 750 $in^2$, or within ranges bordered by any of these area values as endpoints. Of course, according to particular contemplated uses and environments, other larger or smaller fin areas are also contemplated. Relatively large fin areas provide an advantage, in that substantially more thermal energy is removed from the coolant before it reaches reservoir 125. This advantage allows higher engine temperatures to be cooled in a shorter period of time. On the other hand, smaller fin areas can reduce the overall size of the structure, fan size, etc.

The coolant or other engine fluid cooled by heat exchanger 130 proceeds along portion 140 of hot coolant path 90 to reservoir 125. Portion 140 is also called a "hot" fluid return tube. Reservoir 125 contains a desired amount of engine coolant 150 or other fluid. As shown, hot fluid return tube 140 enters reservoir 125 at an upper portion thereof, keeping the warmest fluid at the upper level of reservoir 125 and minimizing the mixture of hot and cold fluid. Additionally, the distal end of return tube 140 includes portion 160 extending at an upward angle, e.g. at a 90 degree bend, to direct fluid flow toward the very top of reservoir 125. This configuration also helps to minimize undesirable mixing of hot and cold fluid, allowing system 50 to pump the greatest amount of cold fluid to engine 60 and thereby decreasing engine cool-down time.

Reservoir 125 can be of any desired size, depending on the size of other components in system 50, the reasonable time available to cool down engine 60 and allow system 50 subsequently to recover, etc. For example, reservoir 125 can have a capacity of about 20 gallons, about 19 gallons, about 4 gallons, a number of gallons generally equal to the coolant (or other fluid) capacity of engine 60, etc. An advantage of a smaller capacity is that the system heat exchanger(s) need work on a smaller amount of fluid, decreasing the recovery time of system 50 (though increasing the time needed for engine 60 to cool down). An advantage of a larger capacity, on the other hand, is the ability to hold a relatively large amount of reduced-temperature coolant in reserve, so that engine cool-down time is decreased (though recovery time increases). According to one embodiment, a relatively large-capacity reservoir (e.g. about 19 gallons) can be provided so that the option exists to use a relatively large amount of fluid, but smaller amounts (e.g. about 4 gallons) of fluid can actually be used in the large-capacity reservoir and/or the remainder of system 50. Reservoir 125 or its housing also includes or supports coolant fill tube 170 and breather 180, visible in each of FIGS. 2–6.

System 50 also includes "cold" coolant path 200 for routing coolant or other engine fluid from reservoir 125 back toward engine 60. Cold coolant path 200 includes outlet 205, which is at the lower end of reservoir 125 to draw the coldest fluid. Coolant pump 210 pumps the fluid throughout system 50. Although coolant pump 210 is illustrated immediately downstream of reservoir 125 in FIG. 2, it can be positioned at virtually any point internal to system 50. Of course, external pumping mechanisms are also contemplated, e.g. a water pump associated with engine 60. Pump 210 can be of a size or rating chosen to work well with the other components of system 50. According to one example, pump 210 can be rated at 5 gpm, although other ratings are contemplated.

Cold coolant path 200 also includes liquid-to-liquid heat exchanger 220, for additionally decreasing the temperature of coolant 150 as it returns to engine 60. Liquid chiller assembly 230 is operably coupled with heat exchanger 220 and can include an A/C unit with a refrigeration condenser and other components. Chiller assembly 230 delivers chilled refrigerant to heat exchanger 220 by line 240 and receives recirculated, warmed refrigerant by line 250. Refrigerant in line 240 can be as cold as possible without freezing the fluid within system 50, e.g. about 35° F., about 40° F., or any other desired temperature. Of course, warmer or colder refrigerant temperatures are also contemplated. Chiller assembly 230 preferably includes a hot gas bypass valve to provide safety against freezing.

The size/capacity of chiller assembly 230 can vary, depending on the size of reservoir 125, the length of time reasonably available to cool down engine 60 or allow system 50 subsequently to recover, and/or other factors. A "three ton" unit, i.e. rated at 36,000 BTU/hr, is one example of refrigeration condenser that can be used. Other condensers, e.g. 5500 BTU/hr, are also contemplated. The size of liquid-to-liquid heat exchanger 220 can be matched or correlated to the size of chiller assembly 230 for most efficient operation, avoidance of cavitation, etc.

From heat exchanger 220, flow continues at 260 to quick coupler 80 and then to engine 60. Fluid pressure gauge 270 and temperature gauge 280 are illustrated for monitoring pressure and temperature parameters within system 50. Of course, these or other parameters can be measured with additional or alternative gauges or other measuring devices, placed at any desired portion of system 50 as appropriate.

In operation, still with reference to FIG. 2, an automobile enters the garage or other vicinity of system 50, with its engine in a "hot" condition. Hoses or other mechanisms are used to connect engine 60 to couplers 70, 80. Cold coolant from reservoir 125 is pumped into the automobile's cooling system. As coolant passes through engine 60, hot coolant is pumped into system 50 via coupler 70. As the hot coolant enters, thermal bypass valve 120 is automatically set to direct the coolant to liquid-to-air heat exchanger 130. Heat exchanger 130 removes heat from the coolant before sending it to reservoir 125 via tube 140. Heat exchanger 130 drastically reduces the temperature of the coolant returning to reservoir 125, minimizing the overall temperature in reservoir 125, reducing total engine cool-down time, and providing other advantages. Thermal bypass valve 120 maintains the flow path illustrated in FIG. 2 until incoming coolant (and thus engine 60) reaches a desired temperature, e.g. about 100° F., about 110° F., or other desired temperature, preferably close to the ambient temperature. Then, thermal bypass valve 120 automatically begins to direct coolant along cold fluid return portion 110 of fluid path 90, as illustrated at 290 in FIG. 3, into reservoir 150 at outlet 293. Simultaneously, or ultimately, bypass valve 120 shuts off flow to heat exchanger 130.

Figure 3:
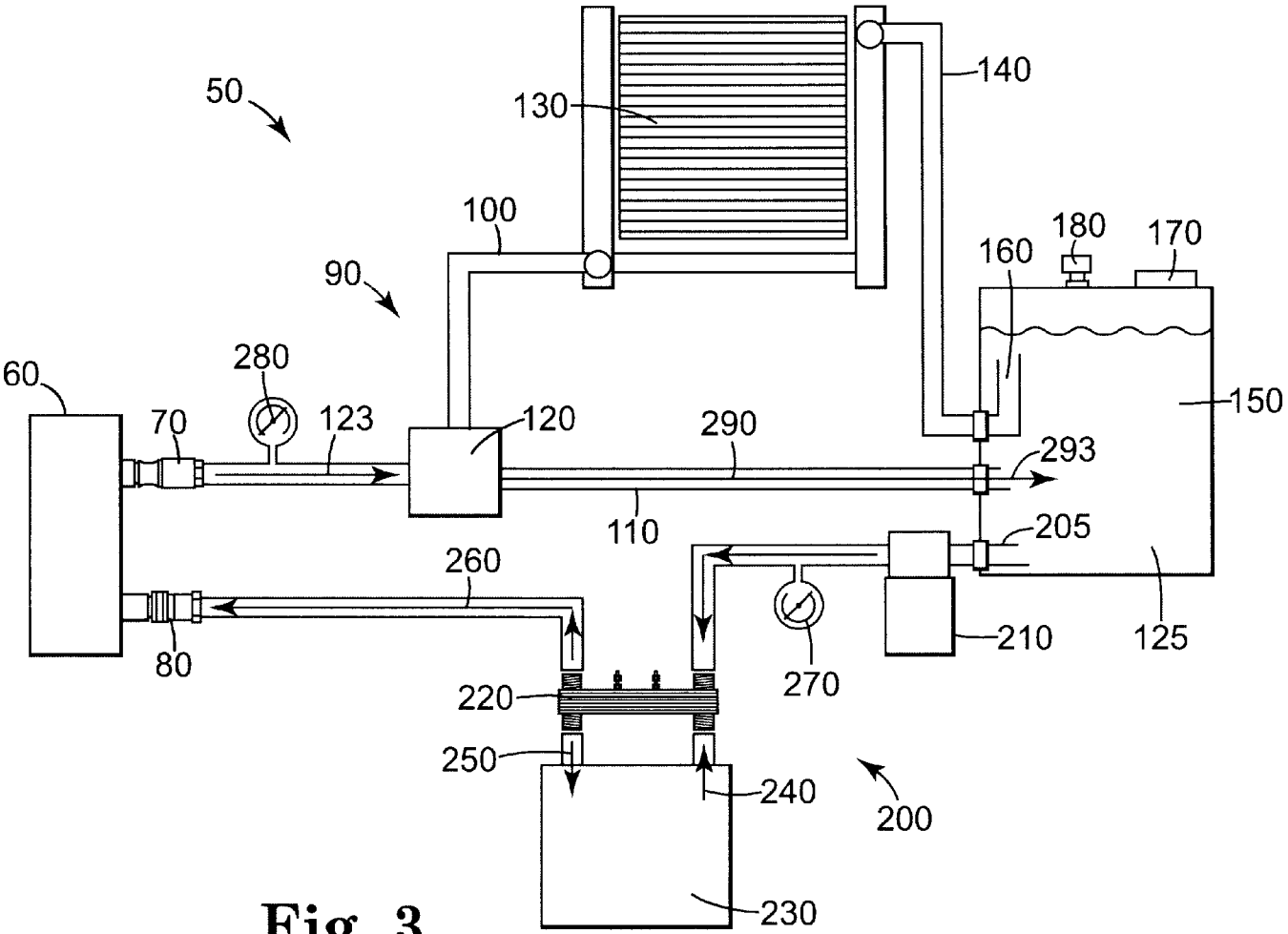
FIG. 3 is a schematic showing the FIG. 2 cooling system in which the engine remains connected but "hot" coolant flow has been diverted.

During the mode depicted in FIG. 3, system 50 remains connected to engine 60 for cool-down. Thermal bypass valve 120 automatically shifts to the position that directs coolant directly back to reservoir 125 via path, 110. Bypassing heat exchanger 130 is advantageous because as incoming coolant from engine 60 reaches the ambient temperature, the ambient air directed across the cooling fins of heat exchanger 130 would begin to add the ambient temperature back to the coolant. In other words, heat exchanger 130 would serve to heat the coolant within system 50 instead of cooling it. Therefore, it is more efficient to direct the coolant away from heat exchanger 130 and directly to reservoir 125.

Figure 4:
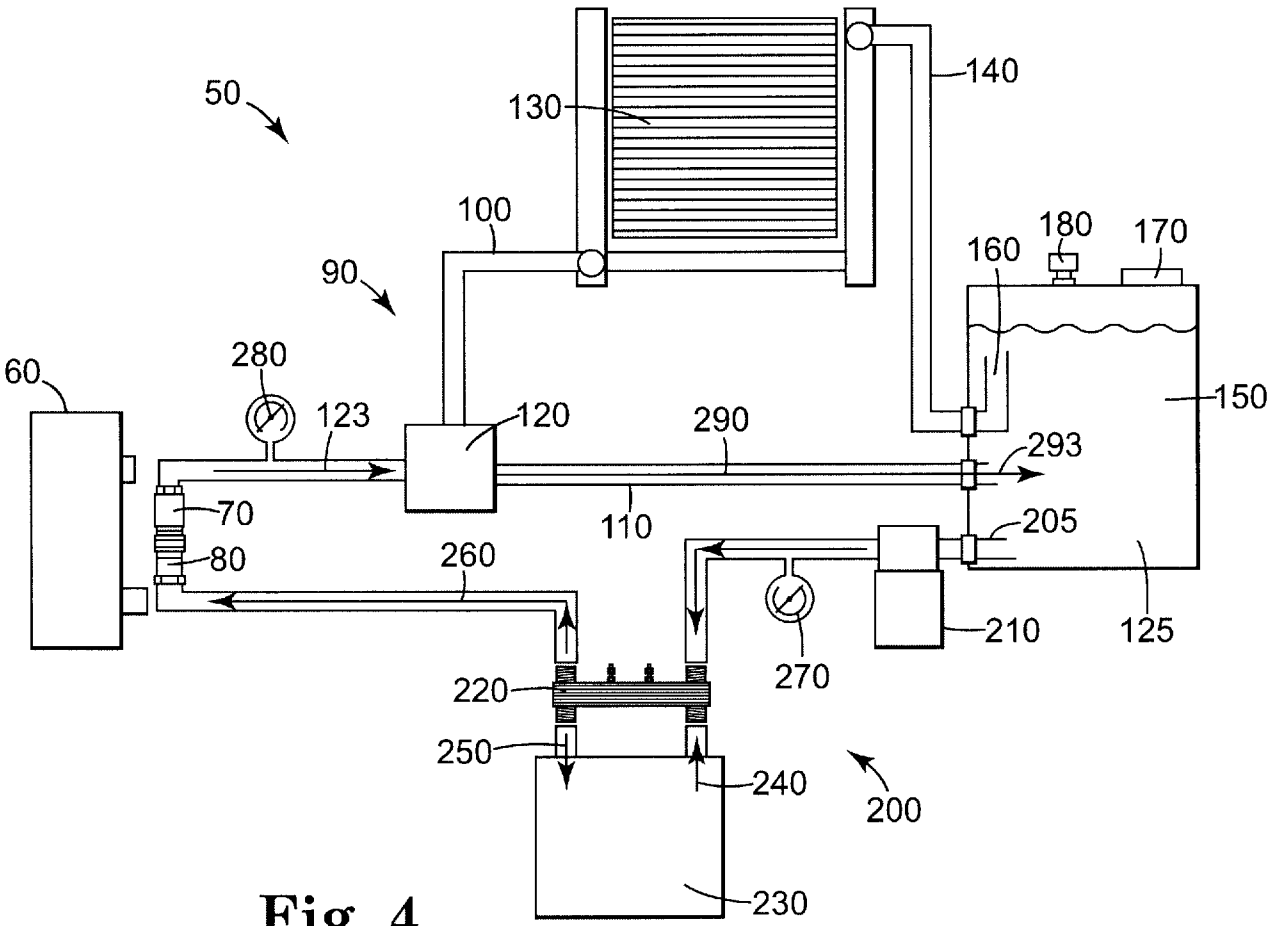
FIG. 4 is a schematic showing the FIG. 2 cooling system in which the quick couplers are disconnected from the engine and instead connected together, to allow the coolant reservoir to reach a desired temperature.

Once engine 60 reaches a desired temperature, quick couplers 70, 80 and/or their associated hoses are disconnected from engine 60 and are instead connected together, as depicted at 295 in FIG. 4. The connection between couplers 70, 80 can be manual, e.g. by physically disconnecting hose ends from engine 60 and connecting them together, or automatic, e.g. by a valve arrangement that automatically connects couplers 70, 80 when hoses are disconnected from them or at another suitable time. Once the connection is established, the "recovery" mode of system 50 begins.

During the recovery mode, system 50 reduces the temperature of the coolant within system 50 to a desired starting temperature, without engine 60 being connected. The starting temperature can be as close to freezing as possible without causing components of system 50 to freeze up. Typically, a desired temperature range for the coolant within system 50 at the end of the recovery mode is between about 40° F. to about 60° F., although other temperatures, e.g. about 35° F., about 65° F., or any other desired temperature, are contemplated as well. Decreasing coolant temperature to this level provides maximum cooling effect, significantly reducing the amount of time needed to cool engine 60 to a desired temperature.

As shown in FIG. 4, coolant flows from reservoir 125 through pump 210 and then through liquid-to-liquid heat exchanger 220. From there, the coolant passes through quick couplers 70, 80, thermal bypass valve 120, and then back to reservoir 125 via path 290. If coolant remaining in system 50 during the recovery mode is at a temperature above e.g. about 100° F. or other temperature close to ambient, thermal bypass valve 120 can alternatively route coolant to liquid-to-air heat exchanger 130, as in FIG. 2.

Figure 5:
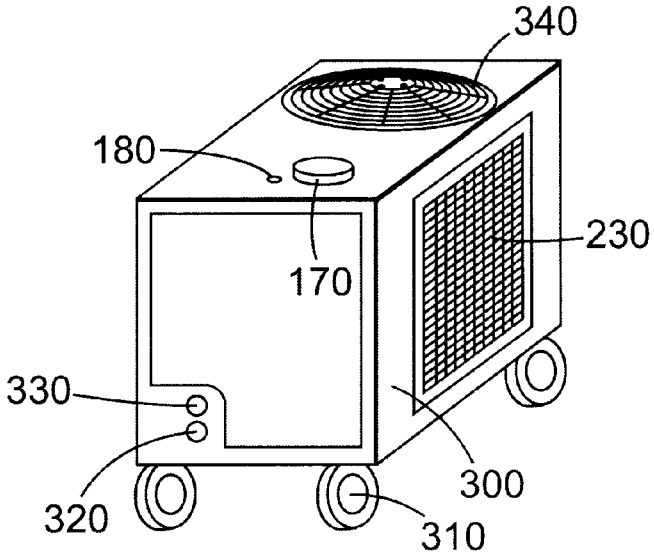
FIG. 5 is a perspective view of a portable cabinet for housing the FIG. 2 cooling system, according to an embodiment of the invention.
Figure 6:
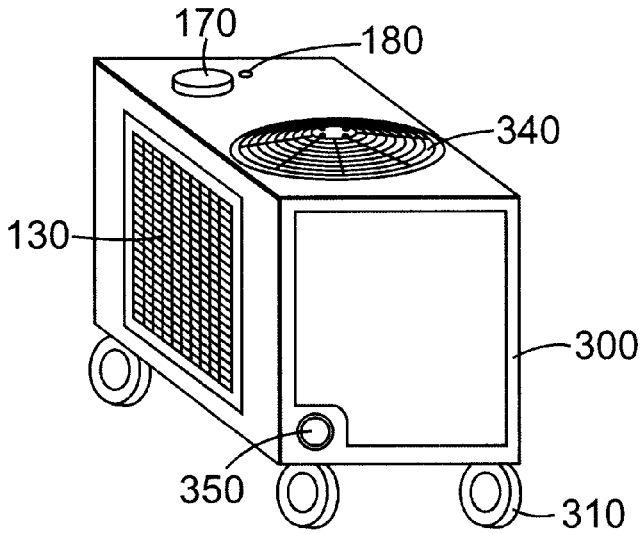
FIG. 6 is a different perspective view of the FIG. 5 cabinet.

FIGS. 5–6 are perspective views showing a portable cabinet design according to an embodiment of the invention. Cabinet 300 includes wheels 310 for supporting and moving cabinet 300 to a desired location, e.g. to a pit area, garage or other vicinity of an automotive engine. Cabinet 300 defines or otherwise provides inlet port 320 and outlet port 330, which can be the same as or connected to quick disconnects 70, 80. Fan 340, preferably a single fan, blows a desired amount of ambient air across the fins of liquid-to-air heat exchanger 130, a portion of which is illustrated in FIG. 6. FIG. 5 illustrates a portion of chiller 230, e.g. an A/C condenser portion. Electrical power plug 350 is also provided, for connecting cabinet 300 and its components to a generator or other appropriate supply of electrical power, e.g. standard 110V or 220V alternating current, one or more batteries, etc. In the case of battery power, one or more batteries can be placed within or otherwise associated with cabinet 300, e.g. to enhance portability, with or without the use of plug 350.

Figure 7:
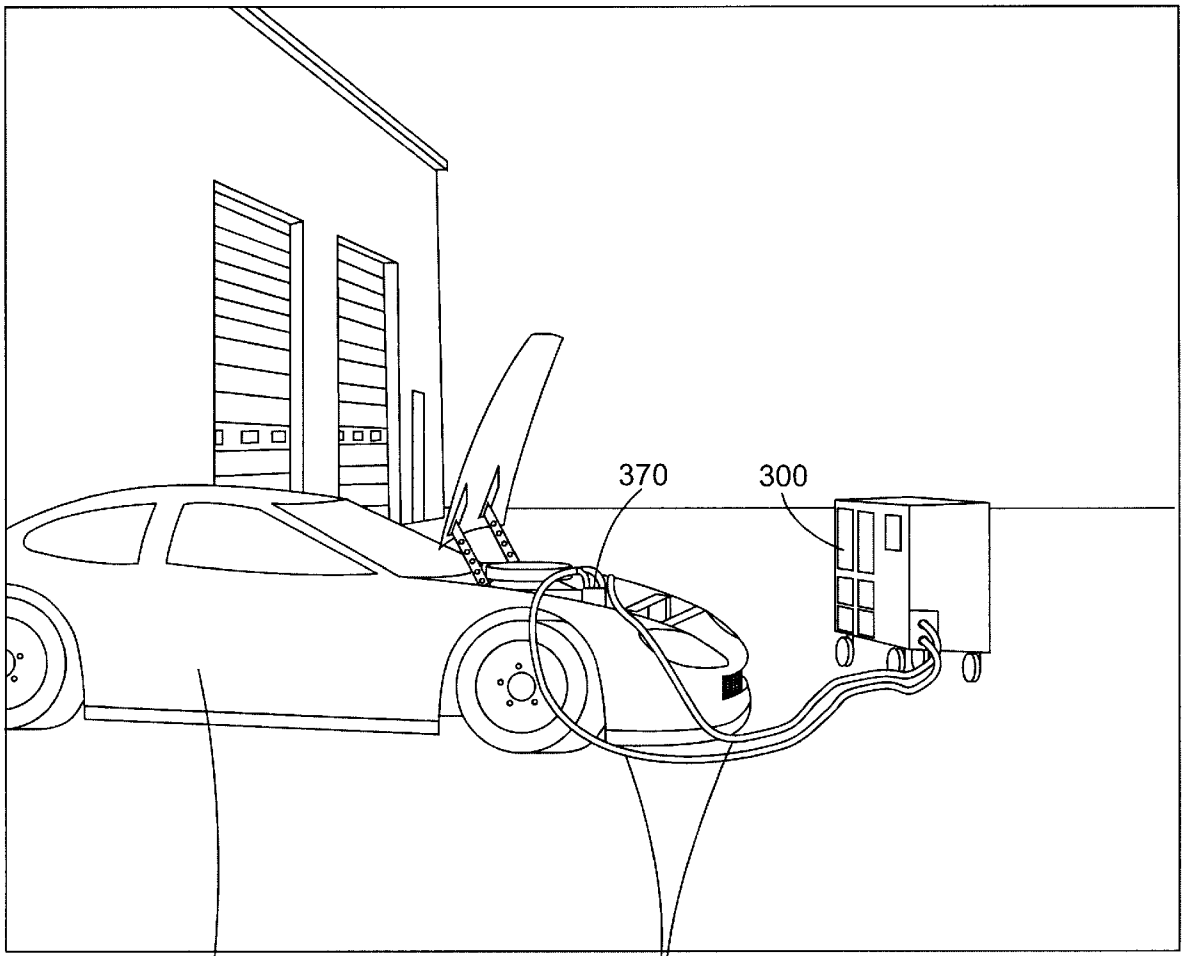
FIG. 7 is a perspective view showing a cooling system according to an embodiment of the invention connected to an automotive engine.

FIG. 7 shows cabinet 300 in-use, connected by hoses 360 to engine 370 of automobile 380. Because system 50 is free of ice, unlike prior-art cooling devices, operation and maintenance of system 50 is much simpler. Additionally, substantial spillage of coolant or other fluid can be generally eliminated, avoiding the disadvantages noted above.

Figure 8:
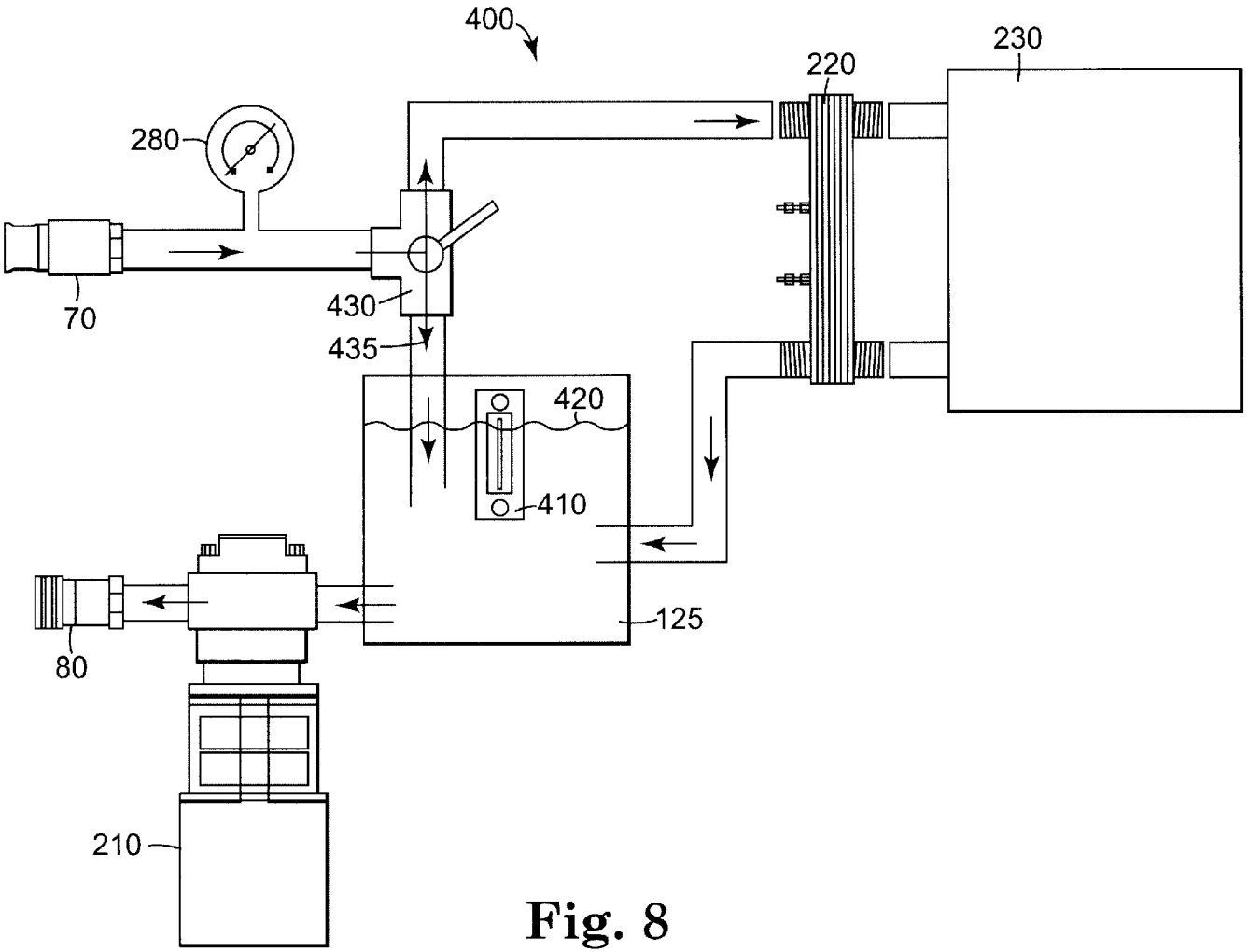
FIG. 8 is a schematic showing a cooling system according to an embodiment of the invention.

FIG. 8 shows an additional embodiment according to the invention. Various components of FIG. 8 have been previously described and will not be described again, to simplify the disclosure. Reservoir 125 of system 400 includes sight gauge 410, for visually indicating the level 420 of fluid within reservoir 125. Coolant control valve 430, illustrated as a manual valve, directs coolant to reservoir 125 either directly, as at 435, or via liquid-to-liquid heat exchanger 220. Automatic operation of valve 430 is also contemplated. FIG. 8 also illustrates that liquid-to-liquid heat exchanger 220 can be disposed upstream of reservoir 125 instead of downstream, and/or that liquid-to-air heat exchanger 130 can be eliminated if desired. Other features of the FIG. 8 embodiment are substantially as described above.

Figure 9:
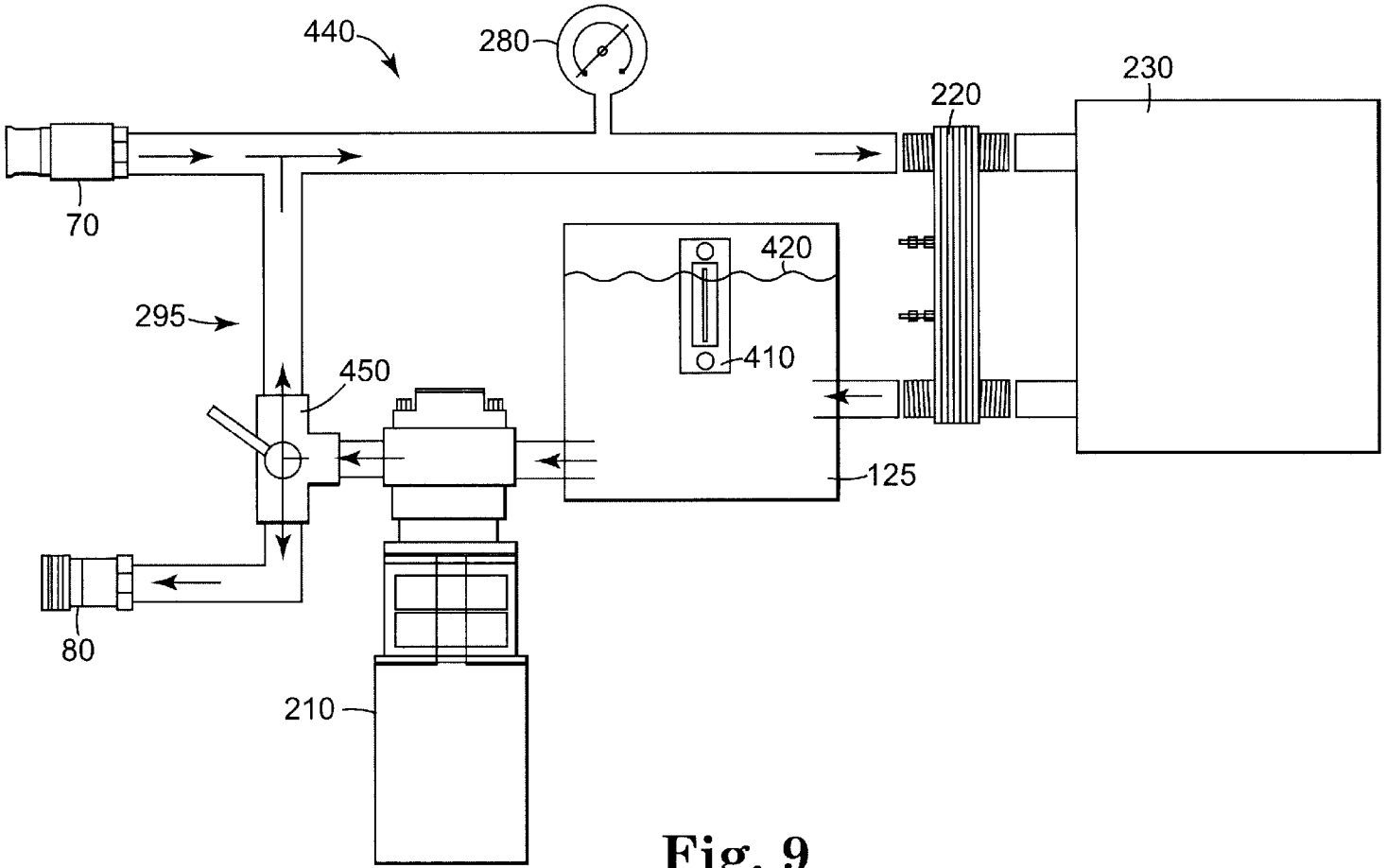
FIG. 9 is a schematic showing a cooling system according to an embodiment of the invention.

The FIG. 9 embodiment illustrates cooling system 440, which includes manual or automatic control Valve 450 for routing return fluid either directly to quick coupler 80, or back to liquid-to-liquid exchanger 220. Valve 450 thus provides a connection akin to that depicted at 295 in FIG. 4.

An electrical schematic according to the invention is shown in the application papers as originally filed and is incorporated herein by reference. Of course, electrical and mechanical arrangements other than those described therein are contemplated and will be apparent to those of ordinary skill/without departing from the scope of the invention.

Tables 1–4 (below) are data tables showing test results according to embodiments of the invention. Initial engine temperatures in Tables 2–4 are indicated at minute "start". Recovery time begins at the minute mark for which system "disconnect" is noted. According to preferred embodiments of the invention, engine cool-down to a desired temperature can occur in about 5 to about 10 minutes, more particularly in about 7 to about 9 minutes, still more particularly in about 5, about 6, about 7, about 8, about 9 or about 10 minutes, any of the times listed in the data tables, rounded to nearest integer, or any other desired time. Initial, "hot" engine temperatures as high as about 300° F. or about 250° F. can be reduced to e.g. about 80° F. to about 110° F., more particularly about 90° F. to about 100° F., any of the temperatures listed in the data tables and/or such temperatures rounded to the nearest 5 or 10, or any other desired temperature. Average rates of temperature decrease in the range of about 15 to about 40 Fahrenheit degrees per minute, more particularly about 20 to about 35 Fahrenheit degrees per minute, about 30 to about 40 Fahrenheit degrees per minute, or about 35 to about 40 Fahrenheit degrees per minute, any of the rates listed in or derivable from the data tables, rounded to the nearest 5 or 10, or any other desired rate, are contemplated.

Prior art devices using e.g. ice can require up to 14 minutes or more to achieve cool-down engine temperatures of e.g. 100+° F. Embodiments of the invention, on the other hand, can cool a 250° F. engine to about 80° F. in about 5 to about 7 minutes. Embodiments of the invention thus can provide faster rates of cooling, decreased cool-down times, and quicker recovery times, all while minimizing or generally eliminating the use of ice and substantial spillage.

TABLE 1

| Notes | Start Temp | End Temp | Total F/Drop | Minutes | Avg/F/Min | Ambient |
|---|---|---|---|---|---|---|
| No restrictions | 275 | 94.2 | 180.8 | 10 | 18.08 | 85.5 |
| 40 Micron on condenser | 280 | 100.1 | 179.9 | 10 | 17.99 | 103 |
| No restrictions | 242 | 94.7 | 147.3 | 10 | 14.73 | 98.2 |
| No restrictions | 277 | 84.8 | 192.2 | 10 | 19.22 | 64.3 |
| AKG70 on until minute 6 Water 4" above Suction | 272 | 81.3 | 190.7 | 10 | 19.07 | 83.2 |
| AKG70 on until minute 7 Water 4" above Suction | 285 | 87.8 | 197.2 | 10 | 19.72 | 81 |
| AKG70 on until minute 6 3 Gals In Tank | 267 | 85.9 | 181.1 | 10 | 18.11 | 85.7 |
| AKG70 on until minute 5 3 Gals in Tank | 277 | 82.5 | 194.5 | 10 | 19.45 | 78.9 |
| 'AKG70 on until minute 5 3 Gals in Tank | 271 | 83.6 | 187.4 | 10 | 18.74 | 76.3 |
| 'AKG40 on until minute 5 3 Gals In Tank | 275 | 88.5 | 186.5 | 10 | 18.65 | 79.6 |
| No external heat exchanger 19 Gals in Tank | 255 | 94.4 | 160.6 | 10 | 16.06 | 75 |
| Water out test: 6 gpm 19 Gals In Tank | 236 | 82.2 | 153.8 | 3 | 51.27 | 85.4 |
| Water out test: 2.5 gpm 19 Gals in Tank | 243 | 72.7 | 170.3 | 8 | 21.29 | 84.1 |
| Water out test: 6 gpm 19 Gals in Tank | 256 | 83 | 173 | 3 | 57.67 | 83.2 |
| | 236 | 81.7 | 154.3 | 10 | 15.43 | 95 |
| | 233 | 97.4 | 135.6 | 10 | 13.56 | 95 |
| | 229 | 102.6 | 126.4 | 10 | 12.64 | 95 |
| | 234 | 106.8 | 127.2 | 10 | 12.72 | 98 |
| | 196 | 103.6 | 92.4 | 10 | 9.24 | 80.2 |
| | 184.2 | 100 | 84.2 | 10 | 8.42 | 84.5 |
| | 197 | 103.8 | 93.2 | 8 | 11.65 | 83.2 |
| | 189 | 104.7 | 84.3 | 10 | 8.43 | 83.6 |
| | 182.4 | 102.1 | 80.3 | 10 | 8.03 | 85 |
| | 182 | 104.3 | 77.7 | 10 | 7.77 | 85 |
| | 168 | 105.6 | 62.4 | 7 | 8.91 | 73 |
| | 192.3 | 109.7 | 82.6 | 9 | 9.18 | 73 |
| | 229 | 80 | 149 | 10 | 14.90 | 70 |
| | 230 | 88.5 | 141.5 | 10 | 14.15 | 70 |
| | 229 | 90.5 | 138.5 | 10 | 13.85 | 70 |
| | 232 | 88.3 | 143.7 | 10 | 14.37 | 70 |
| | 233 | 92.5 | 140.5 | 10 | 14.05 | 70 |
| | 228 | 95.5 | 132.5 | 10 | 13.25 | 100 |
| | 229 | 95.1 | 133.9 | 10 | 13.39 | 100 |
| | 231 | 96 | 135 | 10 | 13.50 | 95 |
| | 234 | 80.7 | 153.3 | 10 | 15.33 | 98 |
| | 228 | 93.5 | 134.5 | 10 | 13.45 | 100 |
| | 234 | 95.1 | 138.9 | 10 | 13.89 | 100 |
| | 231 | 99.8 | 131.2 | 9 | 14.58 | 100 |

TABLE 2

| Minute | Engine Temperature | Tank Temperature | Outlet Temperature |
|---|---|---|---|
| Start | 253.0 | — | — |
| 1 | 126.1 | 60.0 | 69.5 |
| 2 | 103.4 | 68.2 | 73.3 |
| 3 | 93.2 | 73.0 | 75.0 |
| 4 | 89.3 | 73.6 | 75.6 |
| 5 | 84.5 | 73.4 | 74.5 |
| 6 | 83.5 | 72.6 | 71.3 |
| 7 | 78.1 | 72.0 | 70.1 |
| 8 | Disconnect | 70.0 | 68.4 |
| 9 | | 67.2 | 67.7 |
| 10 | | 65.0 | 66.4 |
| 11 | | 61.6 | 65.0 |

TABLE 2-continued

| Minute | Engine Temperature | Tank Temperature | Outlet Temperature |
|---|---|---|---|
| 12 | | 58.8 | 63.6 |
| 13 | | 56.2 | 62.3 |
| 14 | | 53.6 | 61.2 |
| 15 | | 52.0 | 60.1 |
| 16 | | 49.6 | 59.1 |

TABLE 3

| Minute | Engine Temperature | Tank Temperature | Outlet Temperature |
|---|---|---|---|
| Start | 254.0 | — | — |
| 1 | 128.0 | 62.4 | 67.8 |
| 2 | 95.7 | 75.0 | 73.1 |
| 3 | 86.9 | 76.0 | 75.2 |
| 4 | 76.1 | 76.2 | 75.6 |
| 5 | 78.9 | 76.0 | 75.5 |
| 6 | Disconnect | 74.4 | 72.8 |
| 7 | | 71.6 | 70.7 |
| 8 | | 68.0 | 68.6 |
| 9 | | 66.4 | 67.5 |
| 10 | | 63.6 | 66.1 |
| 11 | | 60.8 | 64.9 |
| 12 | | 58.2 | 63.7 |
| 13 | | 55.8 | 62.6 |
| 14 | | 52.8 | 61.3 |
| 15 | | 51.0 | 60.3 |
| 16 | | 49.0 | 59.2 |

TABLE 4

| Minute | Engine Temperature | Tank Temperature | Outlet Temperature |
|---|---|---|---|
| Start | 245.0 | — | — |
| 1 | 129.4 | 53.7 | 64.4 |
| 2 | 95.5 | 71.4 | 67.9 |
| 3 | 88.4 | 73.3 | 70.3 |
| 4 | 87.8 | 73.4 | 70.3 |
| 5 | 84.8 | 72.5 | 69.9 |
| 6 | 79.8 | 71.6 | 69.3 |
| 7 | 78.7 | 70.4 | 68.5 |
| 8 | Disconnect | 67.9 | 66.9 |
| 9 | | 64.7 | 65.6 |
| 10 | | 61.9 | 64.1 |
| 11 | | 59.2 | 62.6 |
| 12 | | 56.3 | 61.1 |

While aspects of the invention have been described with reference to certain examples, the invention is not limited to the specific examples given. Use with a wide variety of vehicles and equipment and with a wide variety of fuels, oils, cooling agents and other fluids is contemplated. Non-automotive cooling applications are contemplated. Various materials can be used according to the invention, e.g. stainless-steel componentry, aluminum, or any material having strength and durability sufficient to withstand the pertinent operational conditions. Components described or illustrated as upstream of certain other components can also be located downstream of them. Various other modifications and changes will occur to those of ordinary skill upon reading this disclosure, and other embodiments and modifications can be made by those skilled in the art without departing from the spirit and scope of the invention.

What is claimed is:

1. A self-contained apparatus for cooling automotive engine fluid, the apparatus comprising:

at least one coupler for connecting the apparatus to an automotive engine, receiving hot engine fluid from the engine and returning cooled engine fluid to the engine;

a fluid reservoir in fluid communication with the at least one coupler, the fluid reservoir containing engine fluid;

a heat exchanger in fluid communication with the fluid reservoir for cooling the hot engine fluid received from the engine;

a chiller operably coupled with the heat exchanger; and a housing containing at least the fluid reservoir, heat exchanger and chiller.

2. The apparatus of claim 1, wherein the housing comprises a readily portable cabinet.

3. The apparatus of claim 2, further comprising wheels for supporting and moving the cabinet.

4. The apparatus of claim 1, wherein the heat exchanger is a first heat exchanger, the apparatus further comprising a second heat exchanger, distinct from the first heat exchanger and in fluid communication with the fluid reservoir, for cooling the engine fluid.

5. The apparatus of claim 4, wherein the first heat exchanger comprises a liquid-to-liquid heat exchanger and the second heat exchanger comprises a liquid-to-air heat exchanger.

6. The apparatus of claim 4, wherein during operation one of the heat exchangers becomes disconnected from engine fluid flow while at the same time the other of the heat exchangers remains connected to engine fluid flow.

7. The apparatus of claim 6, further comprising a thermal bypass valve for connecting and disconnecting said one heat exchanger to and from engine fluid flow.

8. The apparatus of claim 7, wherein the thermal bypass valve is connected to the fluid reservoir by a hot fluid return and by a cold fluid return, said one heat exchanger being disposed along the hot fluid return.

9. The apparatus of claim 8, wherein the hot fluid return enters an upper portion of the fluid reservoir and angles fluid flow toward the top of the fluid reservoir, further wherein the cold fluid return enters a lower portion of the fluid reservoir.

10. The apparatus of claim 1, wherein the at least one coupler comprises two quick couplers for rapid connection to and disconnection from the engine, one of the quick couplers being connected to a fluid-in flow path for receiving hot engine fluid from the engine, the other of the quick couplers being connected to a fluid-out flow path for delivering cooled engine fluid to the engine, the apparatus being constructed such that engine fluid is directed from the fluid-out flow path to the fluid-in flow path when the engine is disconnected from both quick couplers.

11. The apparatus of claim 1, wherein the apparatus is free of ice during operation.

12. The apparatus of claim 1, further comprising a fluid pump, fluidly coupled with the fluid reservoir, for circulating fluid within the apparatus.

13. The apparatus of claim 1, wherein the housing supports an electrical power plug for powering at least the chiller.

14. The apparatus of claim 1, wherein the engine fluid is engine coolant.

15. The apparatus of claim 1, wherein the fluid reservoir has a capacity of about 19 gallons of engine fluid.

16. The apparatus of claim 1, wherein the chiller comprises a condenser.

17. A cooling system for reducing the temperature of an engine, the system comprising:

a coolant reservoir;

a heat exchanger;

a hot coolant path for receiving hot engine coolant from the engine and routing it toward the heat exchanger, the hot coolant path including a first coupler for connection to and disconnection from the engine;

a cold coolant path for routing engine coolant cooled by the heat exchanger toward the engine for reducing the temperature of the engine, the cold coolant path including a second coupler for connection to and disconnection from the engine; and a coolant control device for selectively directing coolant from the cold coolant path to the hot coolant path to selectively bypass the engine.

18. The system of claim 17, wherein the coolant control device directs coolant from the cold coolant path to the hot coolant path to bypass the engine when the engine is not connected to the cooling system.

19. The system of claim 17, wherein the coolant control device comprises a coolant control valve.

20. The system of claim 17, wherein the hot coolant path includes a thermal bypass valve for selectively directing hot engine coolant to a second heat exchanger or bypassing the second heat exchanger.

21. The system of claim 17, further comprising a coolant pump for moving coolant through the system.

22. A self-contained apparatus for cooling automotive engine fluid, the apparatus comprising:

means for connecting the apparatus to an automotive engine, receiving hot engine fluid from the engine and returning cooled engine fluid to the engine;

a fluid reservoir in fluid communication with the at least one coupler, the fluid reservoir containing the engine fluid;

means for cooling the engine fluid, the means for cooling being in fluid communication with the fluid reservoir;

means for chilling operably coupled with the means for cooling; and a housing containing at least the fluid reservoir, means for cooling and means for chilling.

23. The apparatus of claim 22, further comprising means within the housing for bypassing the engine from engine fluid flow.

24. The apparatus of claim 22, wherein the means for cooling comprises two distinct heat exchangers, both for cooling the same engine fluid.

25. The apparatus of claim 22, wherein the housing comprises a wheeled cabinet.

26. A method of cooling automotive engine fluid using a cooling system, the method comprising:

connecting the cooling system to an automotive engine;

receiving hot engine fluid from the automotive engine into the cooling system;

cooling the hot engine fluid within the cooling system;

returning the cooled engine fluid to the engine;

disconnecting the engine from the system; and circulating engine fluid within the cooling system after the engine has been disconnected, thereby cooling engine fluid remaining within the cooling system.

27. The method of claim 26, further comprising using a heat exchanger to cool engine fluid remaining within the cooling system after the engine has been disconnected.

* * * * *